US006491422B1

(12) United States Patent
Rütten et al.

(10) Patent No.: US 6,491,422 B1
(45) Date of Patent: Dec. 10, 2002

(54) MIXER

(75) Inventors: Kurt Rütten, Stäfa (CH); Holger Feurer, Zurich (CH)

(73) Assignee: Rütten Engineering, Stäfa (CH)

( * ) Notice: Subject to any disclaimer, the term of this patent is extended or adjusted under 35 U.S.C. 154(b) by 27 days.

(21) Appl. No.: 09/859,210

(22) Filed: May 16, 2001

Related U.S. Application Data

(60) Provisional application No. 60/204,730, filed on May 16, 2000.

(51) Int. Cl.[7] ..... B01F 11/00

(52) U.S. Cl. ..... 366/116; 366/118; 366/332; 366/335; 366/601

(58) Field of Search ..... 366/116, 118, 366/332, 335, 601, 256, 257

(56) References Cited

U.S. PATENT DOCUMENTS 1,776,405 A * 9/1930 Wilsey
2,513,577 A * 7/1950 Malme
2,552,970 A * 5/1951 Horsley et al.
2,615,692 A * 10/1952 Muller
2,661,938 A * 12/1953 Kuentzel
3,467,363 A * 9/1969 Reichel
3,945,618 A * 3/1976 Shoh ..... 366/118
4,423,945 A * 1/1984 Preston et al.
4,479,098 A * 10/1984 Watson
4,511,254 A * 4/1985 North et al. ..... 366/118
4,562,413 A * 12/1985 Mishiro et al.
4,687,962 A * 8/1987 Elbert
4,732,487 A * 3/1988 Pollard ..... 366/118
4,787,751 A 11/1988 Bakels ..... 366/110
4,983,045 A * 1/1991 Taniguchi ..... 366/256
5,032,027 A * 7/1991 Berliner, III ..... 366/120
5,033,321 A 7/1991 Gerson ..... 73/866
5,088,830 A 2/1992 Muhlbauer ..... 366/108

* cited by examiner

*Primary Examiner*—Tony G. Soohoo
(74) *Attorney, Agent, or Firm*—Gerry J. Elman; Elman Technology Law, P.C.

(57) ABSTRACT

The present invention relates to an apparatus and method for mixing fluids in a manner that ranges from maintaining the integrity of fragile molecular and biological materials in the mixing vessel to homogenizing heavy aggregate material by supplying large amounts of energy. The variety in mixing manner is accomplished using an electronic controller to generate signals to a motor driver in order to control the frequency and the amplitude of the motor, which drives an agitator assembly. The motor may be a stepper motor, a linear motor or a DC continuous motor. By placing a sensor in the mixing vessel to provide feedback control to the mixing motor, the characteristics of agitation in the fluid can be adjusted to optimize the degree of mixing and produce the highest quality mixant, with consistent results.

30 Claims, 13 Drawing Sheets

Rütten Engineering+Trading FA Feurer Automation

Softmixer Mixing Test

Mixing Pattern: Sinus Amplitude 10–50mm, Frequency 1–9Hz
Mixmeter Probe: 17x24mm Pilot 022–03–PS3
Vessel: 100 Liter

| | 1Hz | 2Hz | 3Hz | 4Hz | 5Hz | 6Hz | 7Hz | 8Hz | 9Hz |
|---|---|---|---|---|---|---|---|---|---|
| 10mm | 0.000 | 0.000 | 0.000 | 0.004 | 0.005 | 0.006 | 0.017 | 0.020 | 0.040 |
| 20mm | 0.000 | 0.003 | 0.005 | 0.005 | 0.011 | 0.017 | 0.028 | 0.060 | 0.060 |
| 30mm | 0.000 | 0.004 | 0.007 | 0.010 | 0.016 | 0.033 | 0.060 | 0.060 | 0.060 |
| 40mm | 0.000 | 0.008 | 0.015 | 0.020 | 0.058 | 0.060 | 0.060 | 0.060 | 0.060 |
| 50mm | 0.000 | 0.009 | 0.032 | 0.060 | 0.060 | 0.060 | 0.060 | 0.060 | 0.060 |

Rütten Engineering+Trading FA Feurer Automation

Power Consumption Linear Motor Drive

Test Conditions

| | |
|---|---|
| Motor type | P01−37x240/160x360 |
| Drive unit | E1000−MT |
| Diameter stirrer plate | 230mm |
| Vessel | 100 Liter |
| Fill level from bottom | 460mm |
| Operation | Continuous |
| Test pattern | Sinusoidal |

Power Consumption (Watt)

| | 1Hz | 2Hz | 3Hz | 4Hz | 5Hz | 6Hz | 7Hz | 8Hz | 9Hz | |
|---|---|---|---|---|---|---|---|---|---|---|
| 10mm | | | | | | 27.2W | 34.4W | 48.6W | 69.7W | P1 |
| | | | | | | 24.1W | 31.0W | 38.0W | 45.5W | P2 |
| | | | | | | 3.1W | 3.4W | 10.6W | 24.2W | P3 |
| 20mm | | | | 15.5W | 25.0W | 43.0W | 59.6W | | | P1 |
| | | | | 17.5W | 21.5W | 27.9W | 40.7W | | | P2 |
| | | | | −2.0W | 3.5W | 15.1W | 18.9W | | | P3 |
| 30mm | | 7.8W | 11.8W | 18.9W | 38.5W | 75.1W | | | | P1 |
| | | 12.4W | 15.2W | 22.0W | 31.4W | 45.4W | | | | P2 |
| | | | | −3.1W | 7.1W | 29.7W | | | | P3 |
| 40mm | | 9.1W | 15.8W | 34.4W | 89.8W | | | | | P1 |
| | | 10.9W | 14.7W | 18.5W | 31.1W | | | | | P2 |
| | | −1.8W | 1.1W | 15.9W | 58.7W | | | | | P3 |
| 50mm | | 13.4W | 29.4W | 96.3W | | | | | | P1 |
| | | 12.1W | 19.2W | 29.8W | | | | | | P2 |
| | | 1.3W | 10.2W | 66.5W | | | | | | P3 |

Power loss limitation

| | | | |
|---|---|---|---|
| LinMot | Without cooling | P nominal | 25W |
| | with heat sink | Pn x1.4 | 25.1−35.0W |
| | with active cooling | Pn x2.0 | 35.1−50.0W |
| | out of range | | >50W |

P1 Measured electrical power consumption with vessel filled with water
P2 Measured electrical power consumption with empty vessel
P3 Difference

FIG. 15

MIXER

CROSS REFERENCE TO RELATED APPLICATION

This application claims the benefit under 35 U.S.C. 119 (e) from U.S. Provisional Application 60/204,730 filed May 16, 2000, the entire contents of which are incorporated herein in its entirety by reference.

OVERVIEW

This invention provides an apparatus and associated method for mixing materials, which afford exquisite control over mixing in a wide range of applications. The range extends from heavy duty agitation for preparation of concrete to delicate and precise mixing required for the pre for the preparation of pharmaceuticals and the processing of biological cultures in which living organisms must remain viable through the procedure.

The mixing of fluids involves the creation of fluid motion or agitation resulting in the uniform distribution of either heterogeneous or homogeneous starting materials that form an output product. Mixing processes are called upon to effect the uniform distribution of: miscible fluids such as ink in water; immiscible fluids such as the emulsification of oil in water; of particulate matter such as the suspension of pigment particles in a carrier fluid; mixtures of dry materials with fluids such as sand, cement and water; the chemical ingredients of oral-dosage-form pharmaceuticals; and biological specimens, such as bacteria, while growing in a nurturing media without incurring physical damage.

Mixing may be done in a variety of ways; either a rotating impeller(s) mounted onto a shaft immersed in the fluid mixture agitate(s) the fluid and/or solid materials to be mixed, or a translating perforated plate does the agitation, or the vessel itself containing the materials is agitated, shaken or vibrated. Mixing may be continuous (as when a rotating impeller is used or the containing vessel is vibrated) or intermittent as when the drive mechanism starts and stops in one or several directions.

With any conventional rotational motor, the frequency, generally measured in revolutions per minute (RPM), can be set at any value within a suitable range for different uses, but it is quite rare in fact that the RPM is varied rapidly during use. Mixers using conventional motors are set usually at one RPM, at which they run for the duration of the mixing. Sometimes the RPM may be varied during mixing, but it is either continuously changed slowly or incremented only a few times. The RPM is not usually incremented continuously or over a large number of RPM changes.

With a conventional vibrational mixer, the amplitude can be varied within very narrow limits, and the frequency is generally set at the frequency of the AC power source. Even when using a motor controller with frequency control, the vibrational frequency of a conventional vibrational mixer can be varied only within relatively narrow limits.

When biological tissue is cultivated, all cells must stay suspended in the nutrient broth; that is, the cells should not sediment to the bottom of the vessel in which they are cultivated. However, in agitating living cells so as to minimize sedimentation, the mechanical effect of the agitator should not compromise the integrity of the cells. In the case of rotating agitators, quite often the culture medium creates a turbulent vortex into which the cells are sucked. Under the turbulent vortex conditions, the cells are at greater risk of being mechanically damaged and the continuous supply of oxygen to the cells is not consistently assured.

The present invention provides a vibration mixer driven by an electronically controllable motor, adapted so as to allow virtually unlimited control of the mixing process. To accomplish this, the present invention builds on the developments of U.S. Pat. No. 5,033,321 issued to D. Gerson (the "Gerson Patent"), hereby incorporated by reference in its entirety.

The Gerson patent concerns an apparatus and method for measuring the degree or rate of mixing during the mixing process. The Gerson patent discloses a closed-loop feedback system for use with then available vibration mixers. The Gerson system comprises a sensor that detects certain physical or chemical parameters that indicate the degree of mixing, i.e., the degree of turbulence, which in turn provides a quantitative measure of the degree of homogeneity of the mixed fluid. Through a feedback loop of testing when the key parameters achieve certain values, the Gerson sensor aids in determining that the mixing has achieved a desired level of homogeneity. In developing the feedback system, the Gerson patent reveals that optimal mixing results are achieved by simultaneously adjusting both the amplitude and the frequency of the vibration mixing device. However, the heretofore available vibration mixers have not readily allowed the simultaneous and independent adjustment of both the amplitude and the frequency of vibration in order to take advantage of the Gerson technology. The heretofore available vibration mixers have been restricted to a narrow range of both frequencies and amplitudes. Thus, the present invention provides a vibration mixer that can take ready advantage of the Gerson technology.

In accordance with the present invention, a vibration mixer comprises a motor, controlled by an electronic controller, and an agitator, driven by the motor to agitate a fluid to be mixed; this fluid is sometimes hereinafter called the "mixant." The mixant, which may be entirely liquid or may contain particulates with or without liquid, or foam, generally starts out heterogeneous and is intended to be made at least somewhat more homogeneous. Alternatively, in other embodiments, the mixant is a fluid that is to be agitated in order to maintain a desired state of homogeneity or to aerate or circulate nutrients in a biological fermenter, or the like.

The present invention permits independent and simultaneous adjustment of both the frequency and the amplitude of a vibrational mixer thereby allowing almost unlimited control of the mixing process. Additionally, this invention permits the adjustment of the vibrational rate from extremely low frequencies to frequencies in the order of 10 Hz or greater. Furthermore, this invention permits the adjustment of the amplitude of vibrational travel from micrometers to meters, depending on the size and scale of the mixer vessel. Additionally, this invention permits the adjustment of the waveform of the vibrational mixing to sinusoidal, pulsatile, square-wave, or to a complex waveform, any of which can be programmed into the control unit.

There are numerous alternative embodiments of the vibration mixer of the present invention, any and all of which can be selected depending on the user's needs and the mixing process being performed. One embodiment is a configuration to provide up and down (or alternatively a horizontal back and forth) oscillatory motion of the agitator to bring about the desired mixing. In still another embodiment the mixer may be configured to provide discrete steps in rotational motion to effect the desired mixing.

Where the motor provides rotational motion, as by a stepper motor, the rotational velocity, or instantaneous RPM, may be caused to change rapidly many times during each revolution or up-and-down oscillation. In this invention, an operator may program the changes at will RPM so as to create any step-by-step pattern desired. In comparison to a conventional rotational mixer, the instantaneous RPM can be varied in very small intervals of time and rotation, such that one rotational step can be fast or slow, or forwards or backwards, within broad limits.

In accordance with the present invention, the motor may be a linear motor, a stepper motor or a DC continuous motor. Selection of the preferred motor may depend on the agitating profile which may include, for example, the speed, the direction, the continuity or intermittency of agitation, and the amount of energy required to agitate the mixant to the degree appropriate to the task.

The agitator may be, for example, an impeller driven in a circular motion, a perforated stirrer plate moved translationally, or some other means for agitating the mixant. As it relates to a vessel in which the mixant is contained, such an impeller or stirrer plate may have a diameter almost equal to that of the vessel or extend only a small percentage of the cross-sectional area of the vessel. Optionally, several vessels may be mounted on a common support and the mixants therein simultaneously agitated by agitators ganged by connecting bars driven by a single motor.

The vessel may have the diameter of a small glass beaker or a stainless steel vat large enough to accommodate substantial quantities of fluids, e.g. in industrial processes. In accordance with the present invention, the vessel may optionally be sealed, for example, in the event that a toxic material is being processed, or pressure or vacuum is desired during the mixing process.

The controller provides continuous control of the agitation of the mixant, keeping it constant or varying in time, depending on the desired result. The controller comprises an electronic control unit which generates low level control signals and a motor drive unit communicating therewith which provides high level energy to power the motor in accordance with the control signals. Also, the motor drive unit receives position information from the motor and communicates such information to the control unit. The rate of repetitive, i.e. vibrational, motion of the agitator, i.e. rotation or reciprocation, can be programmed within a wide range, e.g. in some embodiments from 0.01 to 10 Hz, or in other embodiments from 0.1 to 6 Hz.

The motion provided by the motor, as powered by the motor drive unit, provides the variations sought by the technician based upon experience or experiment.

In certain embodiments of the invention, a sensor is provided to the vibration mixer to sense a variable related to the degree of mixing of the mixant. As disclosed in the Gerson patent, the sensor sends a signal to a meter device, which in turn sends an input signal, derived from the pressure fluctuation spectra or other measured spectra, to the electronic controller. This input signal to the controller is indicative of fluid motion that is, of fluid turbulence, and provides a feedback loop mechanism by which to electronically vary the driving motor of the mixer, thereby promoting an optimum mixing result in the mixant. By providing a mixer that can continuously adjust to changes to the frequency and the amplitude of the mixing motion as directed by the input signal of the controller to the driving motor of the mixer, the present invention can obtain a desired mixing result in the mixant.

One embodiment of the invention provides agitation of a mixant in a vessel by an agitator. The agitator is electrically powered to produce reciprocating and/or rotational motion in controlled increments, thus generating mixing forces in the fluid contained in the vessel. The motor is adapted to move in steps and moves the agitator in a controlled, incremental manner. It may be a stepper motor, a linear motor, or a DC motor. The motor is directly connected to the agitator via a shaft that extends into the fluid to be mixed. In another embodiment, the agitator is indirectly coupled to the motor by a mechanical element that converts rotational movement to reciprocating movement, or vice versa.

A controller comprises a control unit providing frequency control and amplitude control and further comprises a motor drive unit. The controller drives the motor. The controller may be automatically adjusted by signals based upon feedback information from a sensor in the mixing vessel.

In one embodiment of the invention, the agitator comprises a stirrer plate with a plurality of frusto-conical orifices therein, the plate being perpendicularly attached to the shaft.

In some embodiments of the invention, a stepper motor having a rotating shaft, attached to a low-friction rotation-to-reciprocation converter, by means of a ball-bearing spindle, provides motion to a shaft connected to the agitator. The stepper motor may be synchronous or non-synchronous. Such embodiments are most effective for vessels of 2 to 30 liters.

In other embodiments, electrically powered means for reciprocating the shaft in a controlled manner comprises a linear motor. Such a motor provides reciprocating motion directly to the shaft on which the agitator is mounted, without requiring a ball-bearing spindle as mentioned above. Such embodiments are most effective for vessels of 2 to 300 liters. In still another embodiment, the electrically powered means comprises a DC continuous motor. Such embodiments are most effective for volumes greater than about 300 liters.

The present invention may further comprise a sensor located in the mixing vessel, providing input to a means for determining the degree of mixing of the fluid in the vessel. These elements generate a power spectrum signal indicative of certain physical parameters in the vessel, which is then processed by the control unit to provide adjustment to the frequency and amplitude of the agitation.

Where it is desired to hermetically seal the vessel, e.g. due to toxicity or dangerous emissions, the system may additionally comprise a sealing membrane secured to the shaft, comprising a bellows to prevent leakage around the mixing shaft. In any of these mechanical configurations wherein a stepper motor is used, it is envisioned that the stepper motor controller would be capable of providing appropriate signals to the stepper motor to independently adjust the frequency (e.g. in a range of 0.01 to 5 or even 10 Hz) and the amplitude of mixing within the desired range. The amplitude and the frequency may be desirably displayed digitally and provided in a manner to be recorded or read by a computer for subsequent review.

It is envisioned that the stepper motor controller is part of a feedback loop, such as described in the Gerson Patent to maintain a constant or varying mixing signal, to provide useful mixing in the mixant. Such devices are available from Rüitten Engineering, Stäfa, Switzerland, as MIXMETER™ systems.

Although, for smaller vessels, a stepper motor may effectuate the motion of the agitator; for larger sized vessels, other motors may be used to provide other motion and for a longer agitator. Such other motor be a linear motion motor. Alternatively a DC motor may be used when high power input is needed, for example, in large-scale applications. With electronic control of an appropriate motor, the motion can be driven in any desired cyclic waveform, for example having amplitudes in excess of 1200 mm and speed up to about 10 Hz (cycles per second) with vessel size being the sole limit.

The agitator element of the present invention may be any known impeller or plunger that would be expected to give useful results with the mixant in a vessel of the size to be used with the vibration mixer of the present invention. In the case of the stepper motor providing translational motion in the mixing vessel, a low-friction ball-bearing spindle is driven to provide the desired movement of the agitator.

The agitator, for example, may comprise a stirrer plate with frusto-conical holes, the holes having axes perpendicular to the direction of motion. The agitator disclosed hereinbelow is also an invention.

In certain embodiments using a stepper motor, the plate is moved up and down by the stepper motor in conjunction with a ball-bearing spindle. The conical holes can be arranged to taper from the bottom to the top, from top to bottom or both. One or several plates can be mounted on the agitator shaft, one above the other, movable or fixed in place.

The holes in the stirrer plate, no matter what their shape may have their edges rounded. For use with biological cultures, this is essential to preserve the integrity of the cell culture by reducing turbulence and avoiding rigorous forces on the cultures. The holes in the stirrer plate can have any of various characteristics of diameter, shape, and number, depending on the application. The diameter of the stirrer plate is preferably from 20% to 70% of the mixing vessel diameter but may be any size smaller than the diameter of the vessel, depending on the mixant to be mixed. Also, the amplitude of agitator motion may be from 1 mm to several hundred mm, depending on the container size. The amplitude of agitator motion may be adjustable over a wide range, limited only by the vessel dimension.

When used for sterile or poisonous or pathological media or under vacuum conditions, the vessel and mixer can be sealed. In sealed applications, for low amplitudes, less than 4–5 mm, a sealing membrane made of flexible material suitable to contain the mixant can be used. When high pressure is applicable in the mixing vessel, a counter pressure from outside the sealed application can be applied to provide pressure compensation on the sealing membrane. For agitator amplitudes larger than 4–5 mm, bellows are suitable. The bellows is designed to accommodate the pressure inside the mixing vessel, the amplitude and the frequency of motion of the agitator for long time periods without material failure due to fatigue, and for cleaning in place ("CIP").

The use of a MIXMETER™ system in the feedback loop provides an optimized application for stirring processes that have to run and be documented as batch processes with consistent results. Thus, the same results will be achieved for the same grade of turbulence under increasing or decreasing filling volume with the mixing vessel.

A further embodiment of the invention involves the mixing of the contents of two, three or more vessels at the same time by driving a single motor ganged to a plurality of shafts attached to agitators, in an oscillatory, rotational, or complex waveform, appropriate to the desired mixing. This embodiment provides uniform and optimal mixing to a number of separate batches or samples for experimental or small-batch production purposes.

A mixer of the present invention allows mixing with low shear forces, which is useful for cultivation of cell cultures in suspension, or because of the heavy mechanical requirements of viscous liquids.

In particular, the mixing of shear-sensitive materials, such as living animal, plant or microbial cells, e.g. with low shear forces promotes nutrient renewal at the cell surface without cell damage. Mixing with low shear forces may be achieved by use of a low-shear-inducing agitator, such as an axially driven translational agitator with frusto-conical holes therethrough, having a stroke amplitude in the range of 0.1 to 60 mm and a frequency in the range of 0.1 to 6 Hz, or optionally by a gentle, sinusoidal motion.

The invention allows for the mixing of highly viscous polymer fluids which may become either shear-thickening or shear-thinning: this is achieved by programming the controller to provide the optimal vibration frequencies and the amplitudes to minimize rising viscosity and to minimize polymer chain breakage, while still providing the desired degree of mixing for effective chemical reactions or formulations.

The invention also allows for the mixing of significantly heterogeneous formulations, such as concrete. This would be achieved by providing very large amplitude of motion to lift settled solids from deep within a mixture, and carry them to the surface to produce a homogeneous suspension.

Different from a conventional rotational mixer, embodiments of the invention that rotate the agitator can vary the instantaneous RPM in very small intervals of time and rotation such that one rotational step can be fast or slow, or forward or backwards, within broad limits. Embodiments of the invention that vibrate the agitator up and down or back and forth can vary the vibrational amplitude over a large range as well as the vibrational frequency over a large range. Frequency can vary from extremely low frequencies (Hz) to a maximum determined by the characteristics of the motor employed. Amplitude can range from as small as one step of the motor (as small as a few microns) to a maximum determined by the mechanics of the motor assembly (as large as tens of centimeters). No other mixer has this extremely wide dynamic range and high degree of programmability.

The present invention permits the use of the minimum input energy to achieve the desired result, more precise control of chemical reaction rates, and more precise control of particle size distributions and suspension homogeneity.

BRIEF DESCRIPTION OF THE DRAWINGS

The present invention will be more clearly understood from the description as set forth below with reference to the accompanying drawings, wherein:

FIG. 15 is a table showing motor power consumption in a linear motor embodiment of the invention, measured in a series of tests.

DETAILED DESCRIPTION

Every example confronting an operator has an optimal mixing situation. In many cases, suboptimal mixing is used because the operator has not taken the effort to find the optimal situation. Failure to optimize results in various problems. The simplest is wasted energy and increased cost. More complicated problems involve improper particle size distributions or the killing of fragile mammalian cells during attempted growth processes.

No mixer in the past has had the ability to provide such a wide range of mixing conditions as are provided by a mixer of the present invention. It is capable of extremely gentle, low-shear mixing, which is very difficult to achieve with conventional mixers. However, it is also capable of extremely turbulent mixing, but unlike conventional mixers, this is finely adjustable.

In embodiments employing the feed-back loop described above, the operator may observe the mixing effect of a particular setup and then optimize the setup on the basis of a display provided by a MIXMETER™ device. Where a cell culture broth is intended to be kept in suspension, oxygen content would also be measured and controlled to provide needed aeration.

A properly selected mixer of the present invention can be used to mix any combination of the following phases, two or more at a time:

Low viscosity liquid;
High viscosity liquid;
Liquid with Newtonian viscosity profile;
Liquid with thixotropic viscosity profile;
Liquid with dilitante viscosity profile;
Soluble particulate suspension;
Insoluble particulate suspension;
Colloidal suspension;
Emulsion of immiscible fluids;
Foam of gasses in liquids;
Dispersion of liquids in gasses;
Powder of high-surface energy solid;
Powder of low-surface-energy solid.

Selection of the particular embodiment will depend on the interplay of the scale of operation, degree of turbulence required, effective viscosity of the mixant, and shear sensitivity of the constituents of the mixant. For example, in use with a cell culture broth, the operator would typically make a visual judgment of the mixing effect through observation of a test setup and then vary the parameters in accordance with experience to provide for proper aeration and a mixing This invention is useful for all conceivable mixing situations: industrial, pharmaceutical, household, large or small. It applies to multiple liquids, liquids and solids, liquids and gasses, or different solids, regardless, of the phase volume of the constituents either before or after mixing. Examples range from mixing concrete and sewage treatment beds to animal cells in bioreactors, and the formation of pharmaceutical dispersions, emulsions and aerosols.

Embodiments of the present invention will be described in detail with reference to the accompanying drawings.

Figure 1:
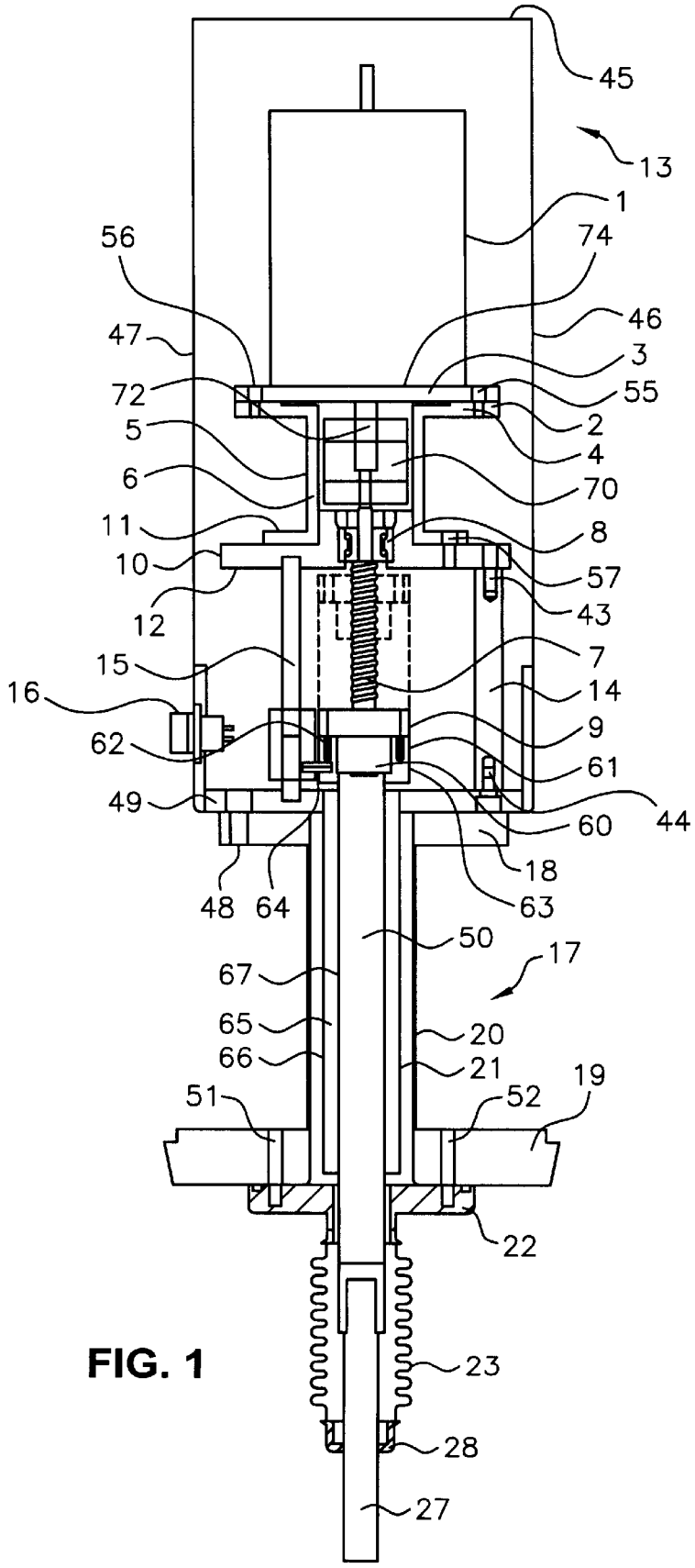
FIG. 1 is a sectional elevation view showing a stepper motor and associated parts, in an embodiment of the present invention.

FIG. 1 shows an enlarged view of the upper portion of a device embodying the invention. This illustration shows the electromechanical elements of this embodiment of the mixing apparatus of the invention. The electromechanical elements include: a motor housing 13, which in this embodiment encloses a stepper motor 1. Such stepper motors and their drive units are readily available, e.g. from Nanotec, Germany. The motor housing 13 comprises a motor housing top wall 45 to securely cover the stepper motor 1 from above. The motor housing 13 further comprises a cylindrical case with side walls 46, 47, motor housing front wall 58 (not shown), motor housing back wall 59 (not shown), and a motor housing bottom base 49 and a stepper motor connector 16.

The stepper motor base 74 is fixably secured to an upper base flange 2. The upper base flange 2 comprises an upper top base 3 and an upper bottom base 4. The upper top base 3 is fixably secured to the upper bottom base 4 by upper flange rivets 55, 56.

The upper bottom base 4 forms the upper portion of the spindle housing 5. The spindle housing 5 comprises a housing outer wall 6, a lower base flange 10, a lower top base 11, and a lower bottom base 12. The lower top base 11 is fixably secured to the lower base flange 10 with a base rivet 57. The spindle housing 5 covers a drive shaft mechanism 70. The drive shaft mechanism 70 further comprises a motor shaft 72, which is rotatably connected to the stepper motor 1 at one end and a ball bearing spindle 7 at its other end. Such ball bearing spindles are available from various sources, including Star Mannesmann. The lower end of the motor shaft 72 is further enveloped by a spindle upper sleeve 8.

The lower end of the ball bearing spindle 7 is enveloped by a spindle lower sleeve 9. The spindle lower sleeve 9 is fixably connected to an upper drive shaft casing 61 with casing rivets 62, 63. A spindle housing support 14 secures the lower base flange 10 to the motor housing bottom base 49. The lower base flange 10 is rigidly secured to the upper portion of the spindle housing support 14 with a housing rivet 43. The motor housing bottom base 49 is rigidly secured to the lower portion of the spindle housing support 14 with a housing rivet 44. The lower base flange 10 is further rigidly connected to the spindle lower sleeve 9 with a rod 15. The upper portion of the rod 15 is rigidly connected to the lower base flange 10 through the lower bottom base 12. The lower portion of the rod 15 is rigidly connected to the motor housing bottom base 49. The lower portion of the rod 15 is further fixably connected to the upper drive shaft casing 61 with a connecting peg 64. The upper drive shaft casing 61 further comprises an upper drive shaft cover 60.

The drive shaft housing 17 comprises a drive shaft housing upper base 18, a drive shaft housing lower base 19, a drive shaft housing outer sleeve 20, and a drive shaft housing inner sleeve 21. The drive shaft housing upper base 18 forms the upper portion of the drive shaft housing 17. The drive shaft housing upper base 18 is fixably connected to the motor housing bottom base 49 with a drive shaft housing rivet 48.

The drive shaft housing 17 envelops a drive shaft slip 65. The drive shaft slip 65 comprises an outer slip wall 66 and an inner slip wall 67. The drive shaft slip 65 envelopes a drive shaft 50. The upper drive shaft cover 60 envelops the upper portion of the drive shaft 50. The upper portion of the drive shaft 50 is rotatably secured to the ball bearing spindle 7 within the upper drive shaft cover 60.

The drive shaft housing lower base 19 is fixably secured to the drive shaft housing lower flange 22 with drive shaft housing lower base rivets 51, 52. The lower portion of the drive shaft housing lower flange 22 is rigidly secured to a sealing bellow 23. The lower portion of the sealing bellow 23 terminates at a sealing plug 28. The sealing bellow 23 covers the lower portion of the drive shaft 50, and the upper portion of an agitator, which in this embodiment is stirrer 27. The lower portion of the drive shaft 50 is rigidly secured to the upper portion of the stirrer 27.

Figure 2:
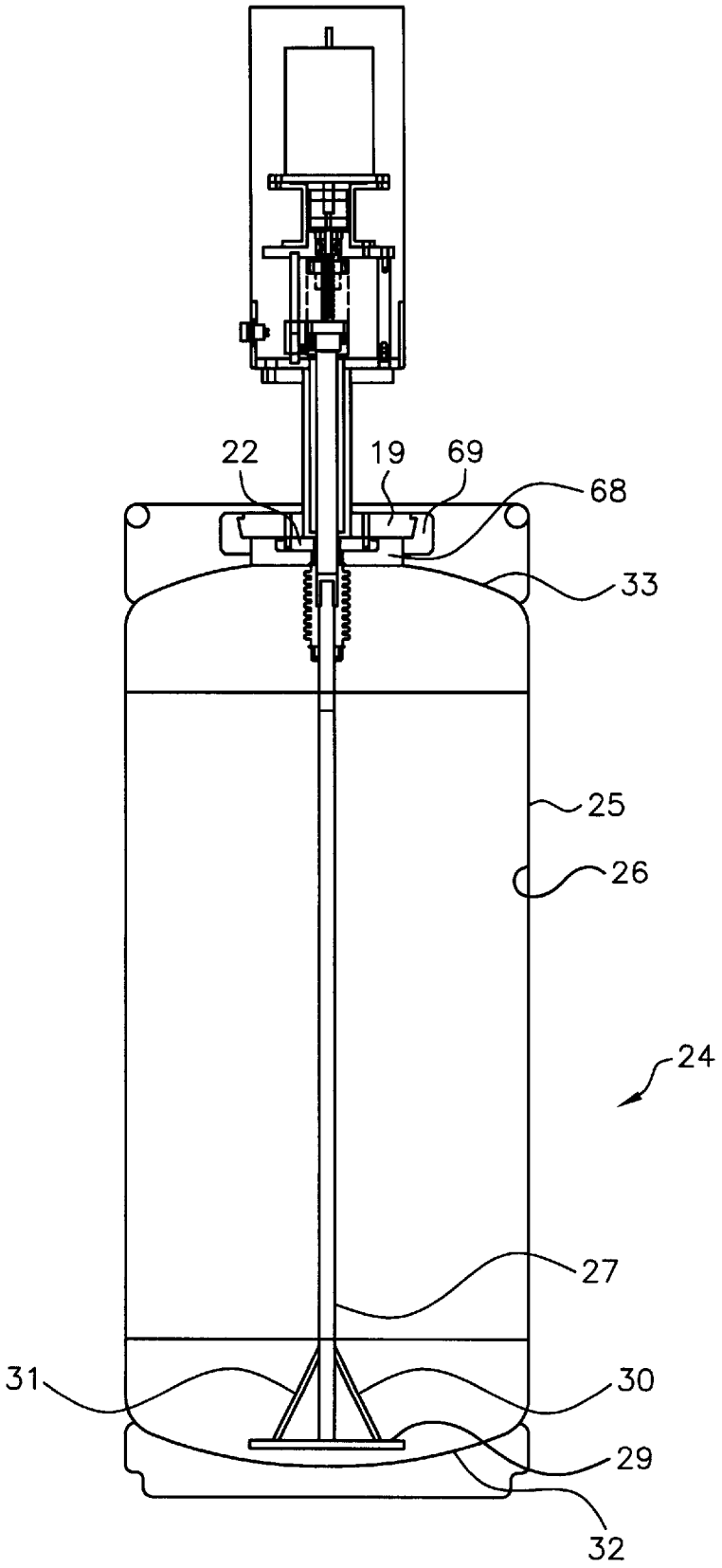
FIG. 2 shows the embodiment of FIG. 1, in sectional elevation view, including the mixing vessel, agitator element, sealing bellows, and accompanying parts.

FIG. 2 shows the lower portion of the mixing assembly. This section of the invention displays the mixing vessel 24 of the apparatus along with its accessories. This figure shows mixing assembly comprising a mixing vessel top wall 33, a mixing vessel outer wall 25, a mixing vessel inner wall 26, and a mixing vessel bottom wall 32. The mixing vessel bottom wall 32 is curvilinear in shape in order to withstand internal pressure. The mixing vessel top wall 33 is also curvilinear in shape, and is rigidly attached to the drive shaft housing lower base 19 with a joining member 68. The joining member 68 is further rigidly attached to the bottom and side portions of the drive shaft housing lower flange 22. A further attachment member 69 rigidly secures the drive shaft housing lower base 19 to the joining member 68.

In this embodiment, the stirrer 27 terminates with a stirrer plate 29. The stirrer plate 29 is rigidly attached to the stirrer 27 at the center of the stirrer plate and with agitator legs 30, 31. The agitator legs 30, 31 are rigidly attached to the stirrer 27 at an angle disposed downwardly to the stirrer plate 29.

Figure 3:
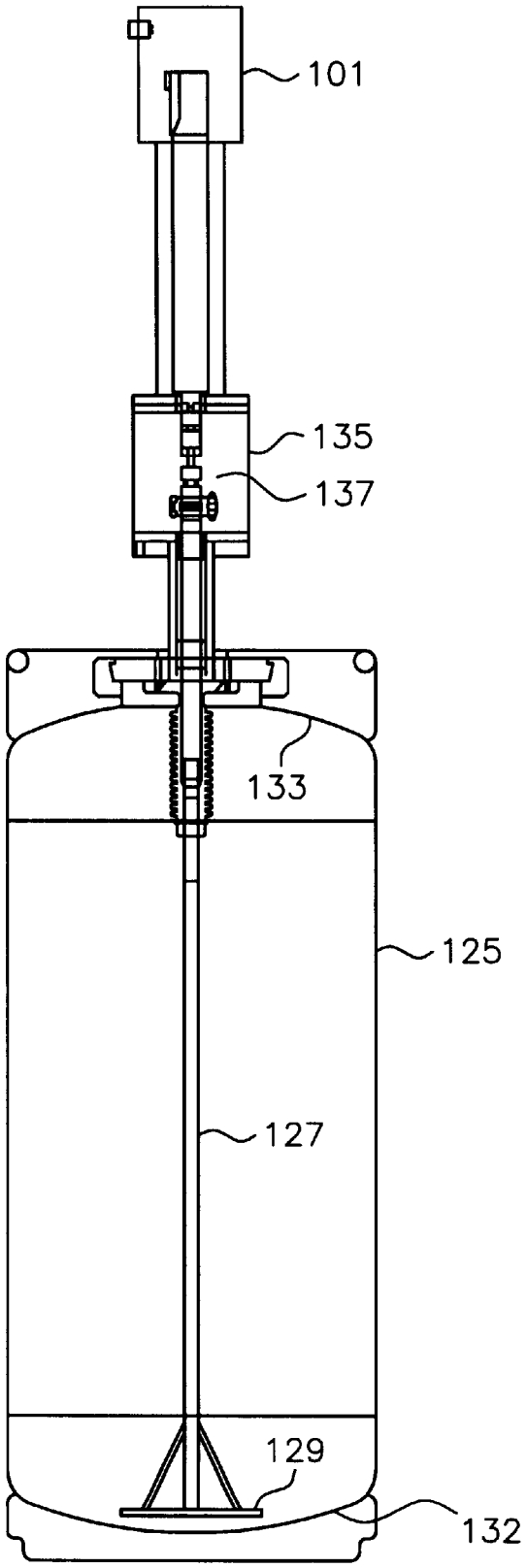
FIG. 3 is a sectional elevation view of another mixer of the present invention, incorporating a linear motor, with a sealed vessel.

FIG. 3 depicts the cross-section view of an embodiment of the present invention in which a linear motor is employed. Such linear motors and their drive units are available from various sources, including Sulzer Electronics of Switzerland. Many of the parts are similar or identical to those of the embodiment shown in FIGS. 1 and 2, and so will not be described in detail again. The linear motor 101 moves the stirrer plate 129 up and down by transfering the motor's translation motion through the coupler 137 housed in envelope 135. The mixing vessel 125 has within, the stirrer 127 with stirrer plate 129 attached thereto. The upper and lower enclosures 133 and 132 are concaved outward to withstand any pressurization that may be applied within the vessel.

Figure 4:
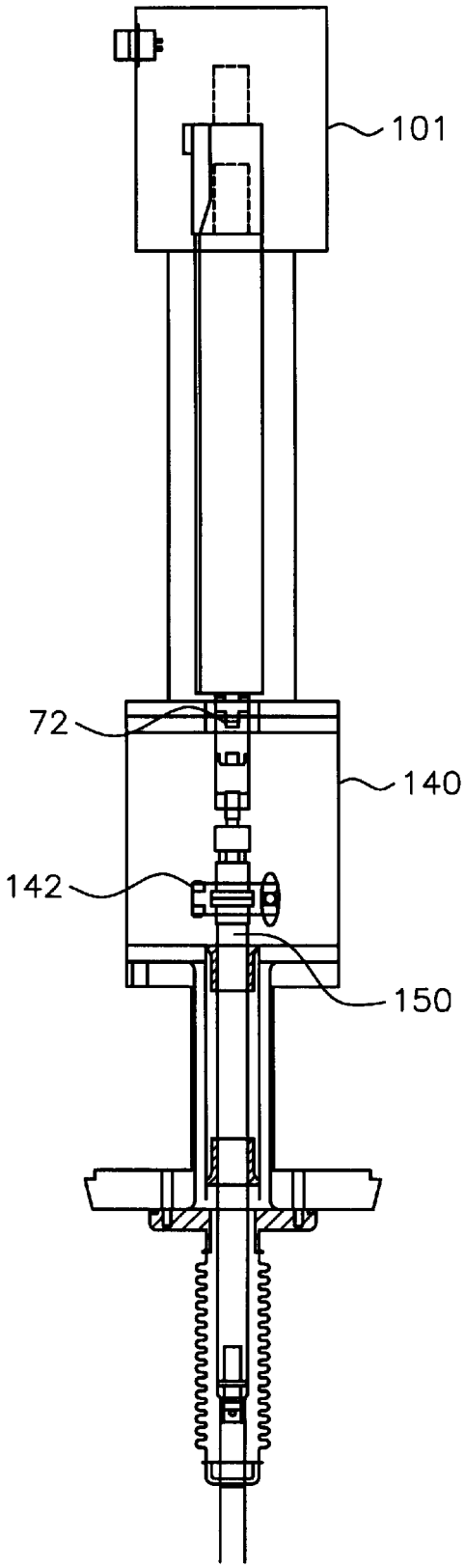
FIG. 4 is a sectional elevation view showing detail of the linear motor drive of FIG. 3.

FIG. 4 is an expanded view of the upper portion of FIG. 3. As shown in FIG. 4, the motor shaft 72 of linear motor 101 is coupled to the stirrer drive 150 within the housing 140 by means of a coupling assembly 142.

Figure 5:
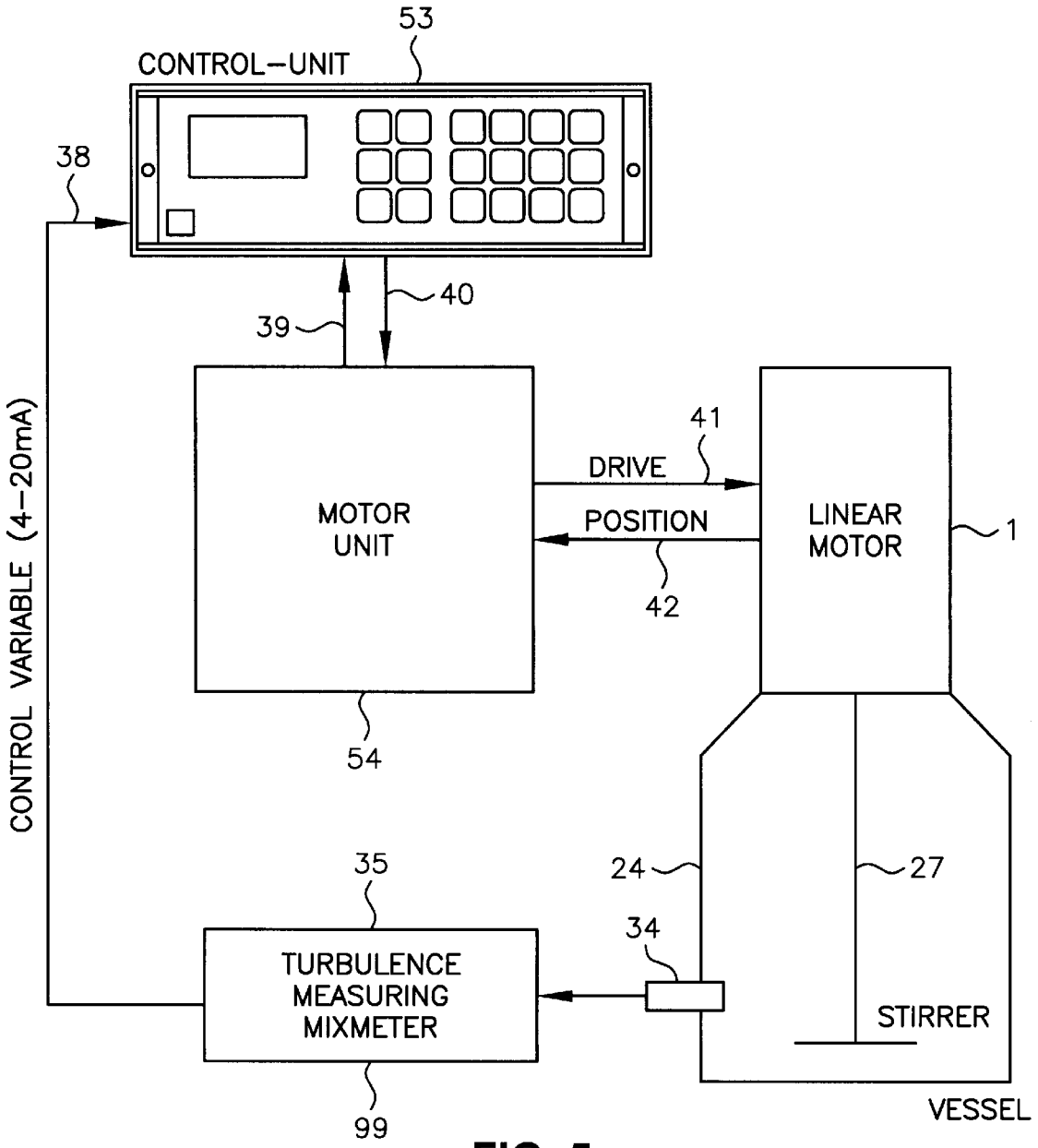
FIG. 5 is a block diagram of an embodiment of the present invention including an automatic control system with feedback loop.

FIG. 5 shows a block diagram of the automatic control system of the invention. The optimization of the mixed output product can best be achieved by providing means for actively sensing the condition of the media being processed and by feedback techniques to automatically adjust the agitation frequency and amplitudes ranges used to achieve the desired end product. Typically, mixers use a wide range of frequencies and amplitudes to achieve the desired mixing. The automatic control system comprises a control unit 53, the MIXMETER device 35 and the vessel sensor 34. The control unit 53 receives control variables via input 38. The control variable input 38 inputs readings from a MIXMETER device 35. The MIXMETER device 35 receives signals from sensor 34, processes it, and sends it along to the control unit 53 via 38. An output display 99 is also part of the MIXMETER device 35 and supplies information for permanent recording of signals from the mixing vessel 24. The automatic control system further comprises, in this embodiment, a stepper motor power unit 54. The stepper motor power unit 54 comprises a stepper motor power unit output 39, a stepper motor power unit input 40, a drive output 41, and a position input 42. The stepper motor power unit 54 outputs 39 to supply position and speed data to the control unit 53. The stepper motor power unit 54 receives input 40 from the control unit 53. The drive output 41 outputs to the stepper motor 1, and the position input 42 inputs from the stepper motor 1. The stepper motor 1 powers the the agitating motion of stirrer 27.

Figure 6:
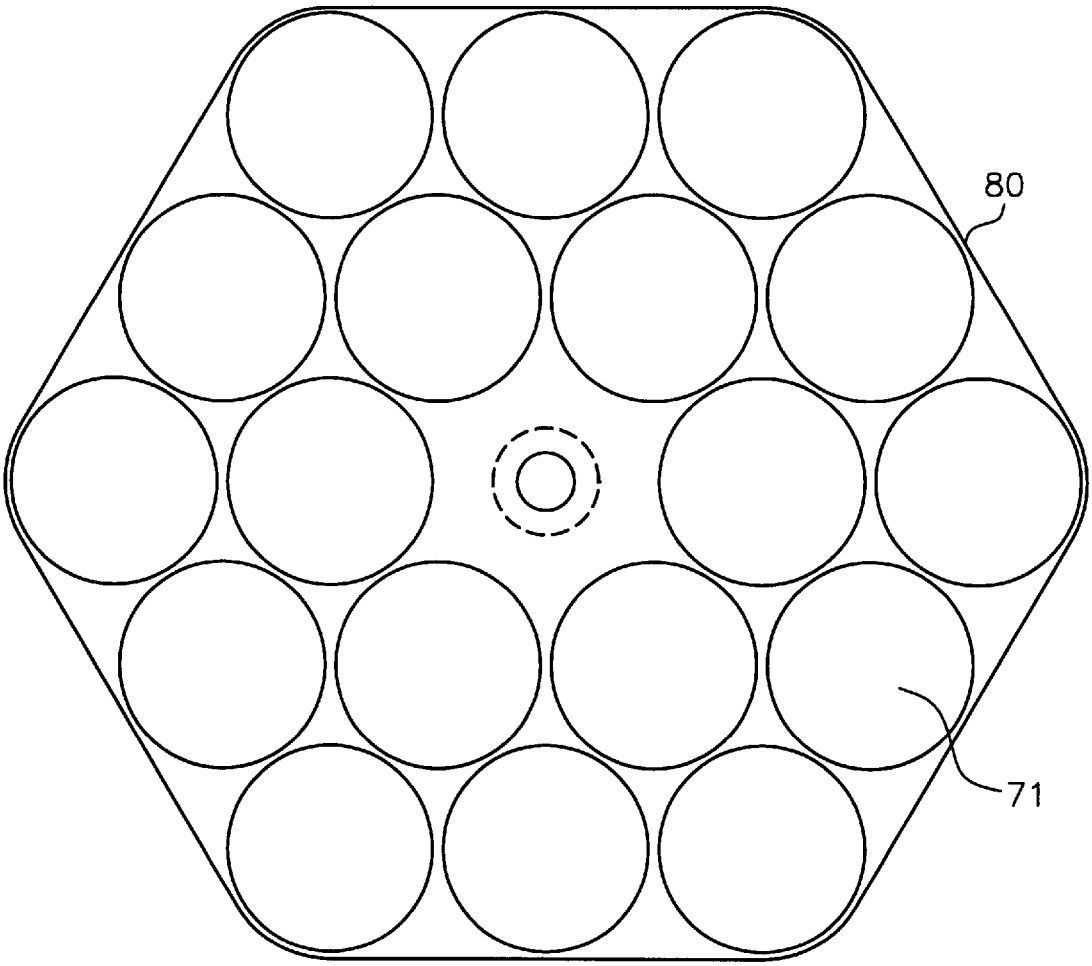
FIG. 6 is a plan view of a stirrer plate that may be used as an agitator.
Figure 7:
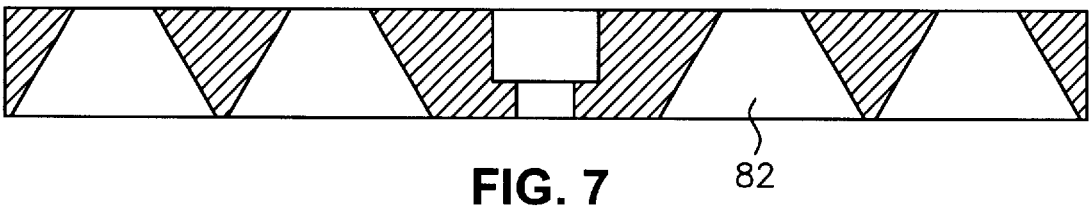
FIG. 7 is a cross-sectiorial view of the stirrer plate of FIG. 6.

FIG. 6 is a plan view of a stirrer plate 80 containing a number of frusto-conical holes 71 with crossection 82 (as shown in FIG. 7) through which the medium being mixed passes. These holes 71 may face upward or downward. Here they face downward. The stirrer plate 80 is affixed to a stirrer 27, 127 as shown in FIGS. 2 & 3. FIG. 7 is a cross-sectional view of plate 80 showing two pairs of frusto-conical holes along a diameter.

Figure 8:
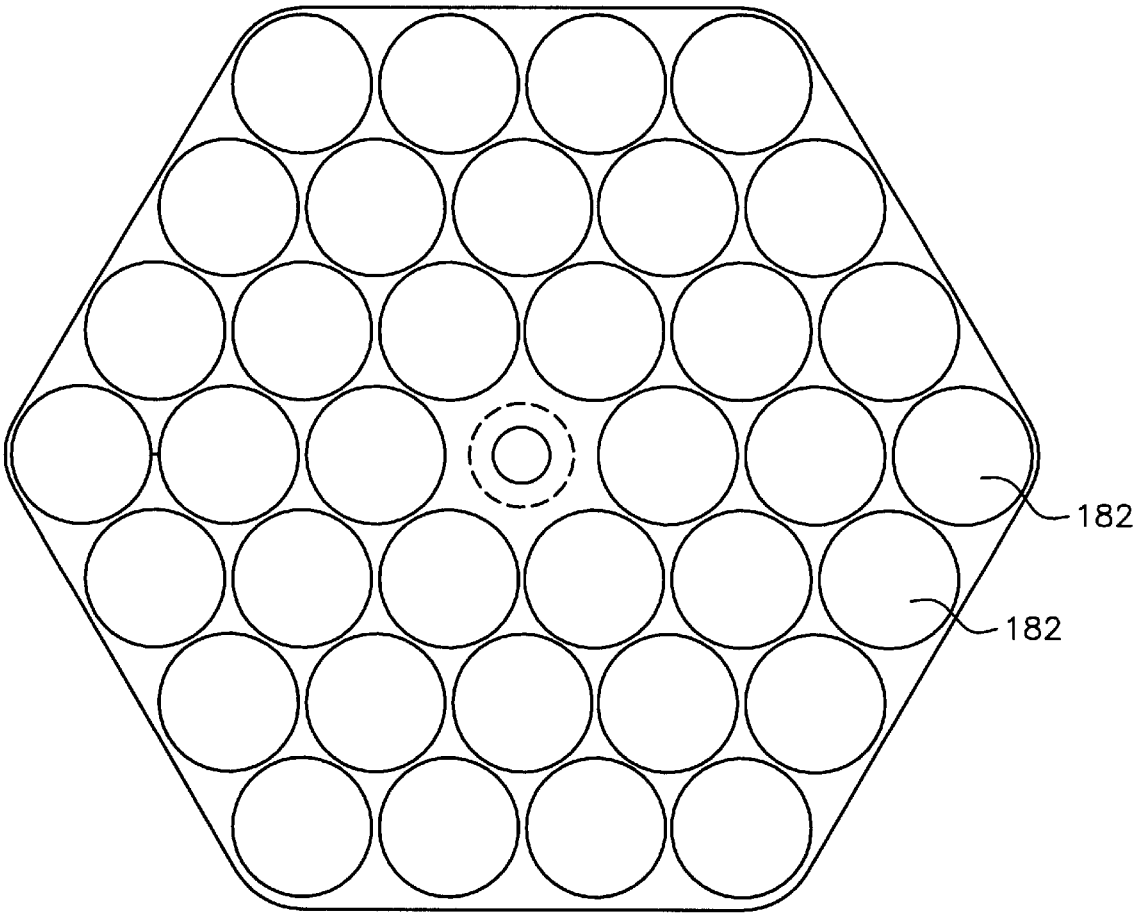
FIG. 8 is a plan view of another stirrer plate.
Figure 9:
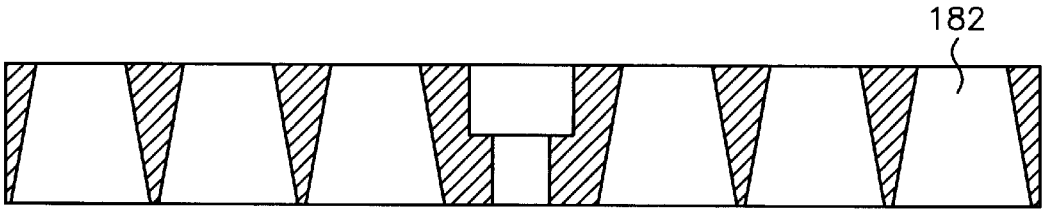
FIG. 9 is a cross-sectional view of the stirrer plate of FIG. 8.

FIG. 8 shows another example of a stirrer plate measuring at its widest end 20 mm thick, 150 mm that is available for use with an appropriate mixant. FIG. 9 is a cross-sectional view of the embodiment of the stirrer plate of FIG. 8. FIG. 9 shows that holes 182 (also shown in FIG. 8) are tapered, with the edges rounded so as to minimize turbulence and abrasion of specimens that are sensitive to severe mechanical activity. The plate of FIG. 9 has a generally hexagonal outline, with two sets of three holes along a diagonal, and may be useful for mixing when low-shear conditions are required.

Figure 10:
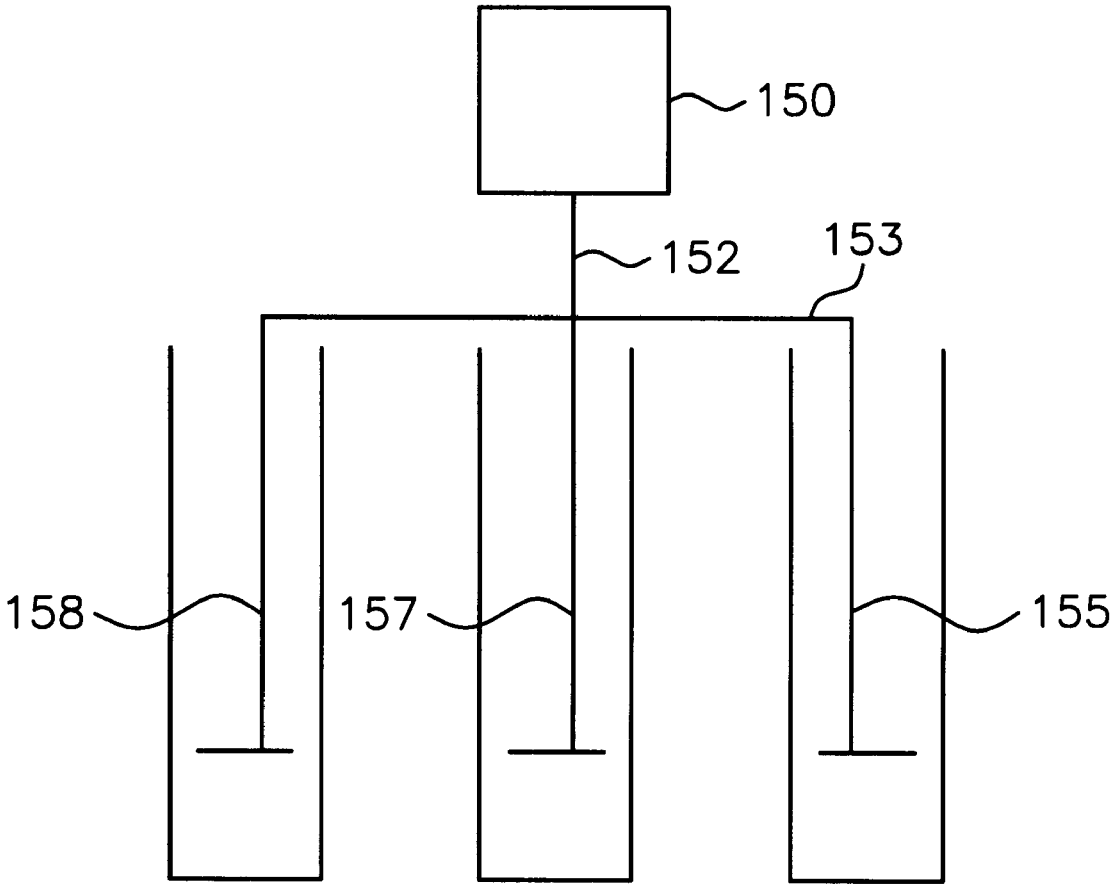
FIG. 10 is a sectional view of an embodiment wherein a single motor drives a plurality of agitators.

FIG. 10 is a cross-sectional view of an assembly of three mixing vessels that are agitated by a common motor. Motor 150 is connected to and powers drive shaft 152, which is connected to a means for connecting to each agitating assembly in each vessel 155, 157, 158. Such means may be a cross beam assembly or may comprise any mechanical configuration that permits the motor to drive each connected agitating assembly so that the mixant in all batched vessels experiences a virtually identical agitating profile. This embodiment permits one motor to process, for example, three batches with an identical agitating profile, thereby allowing consistent treatment of the mixant in each vessel. Batch mixing in this way is not limited to using three vessels.

Figures 11A, 11B:
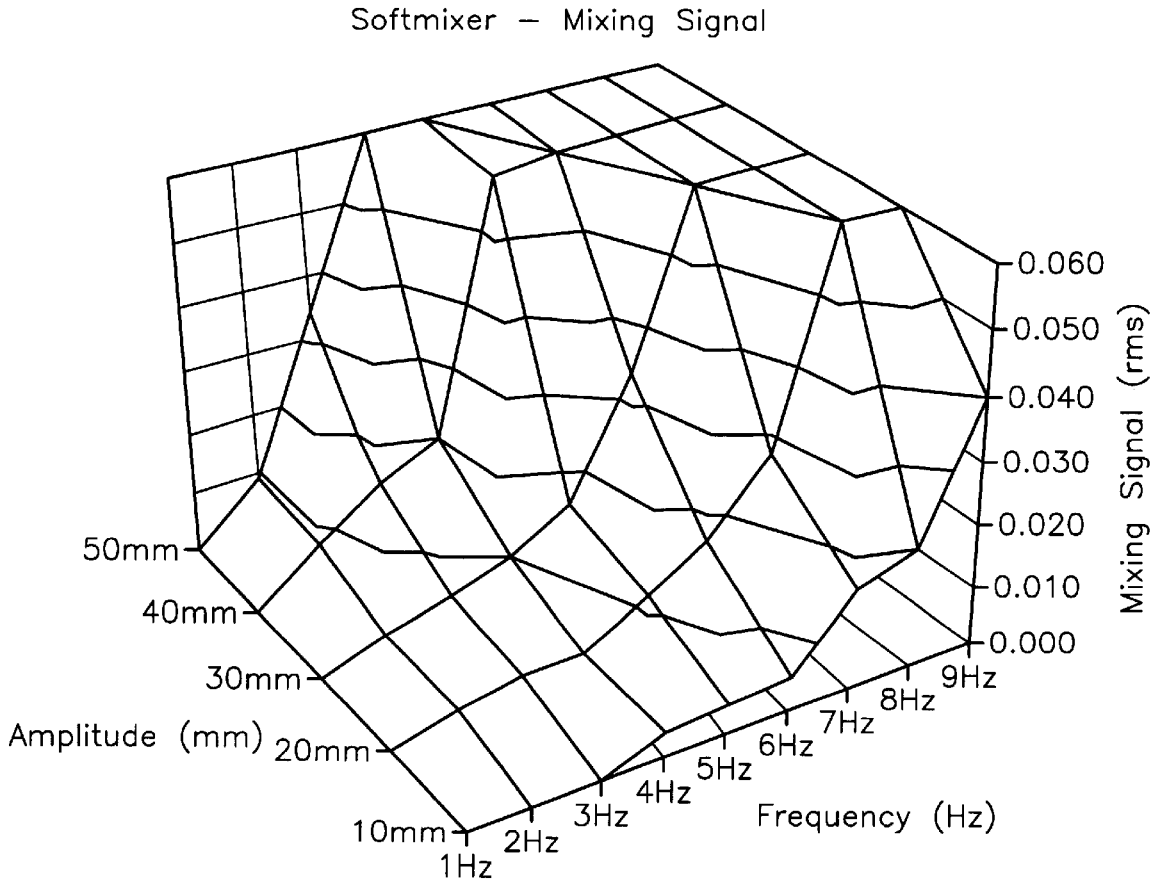
FIG. 11 shows a table and corresponding graph of mixing signal versus frequency and amplitude in a particular test of an embodiment of the present invention.

FIG. 11A is a table, FIG. 11B is a three-axis graph. Together they show the results of a series of tests that were performed with one embodiment of the invention, using a linear motor as shown in FIGS. 3 and 4. FIG. 11 shows the tests were performed using water as a mixant, with a stirrer plate having diameter 148 mm, holes 20 mm, hole angle 20 degrees, as shown in FIGS. 8 and 9. The test setup simulates an aqueous mixant, e.g. a culture of growing cells. A sensor was positioned one-third of the cylindrical height from the bottom of the vessel, using probe 17×29 pilot 022-03-PS3. The frequency of drive energy applied sinusoidally to the motor and the distance the agitator traveled are shown on the X and Y axes in FIG. 11B. The X value varied from 1 to 9 Hz. The Y value varied from 10 to 50 mm. The Z axis indicates the driving signal to the motor drive unit. As the distance and the frequency of agitation increase, the power consumption rises. The graph shows a non-linear relationship among the parameters.

Figure 12:
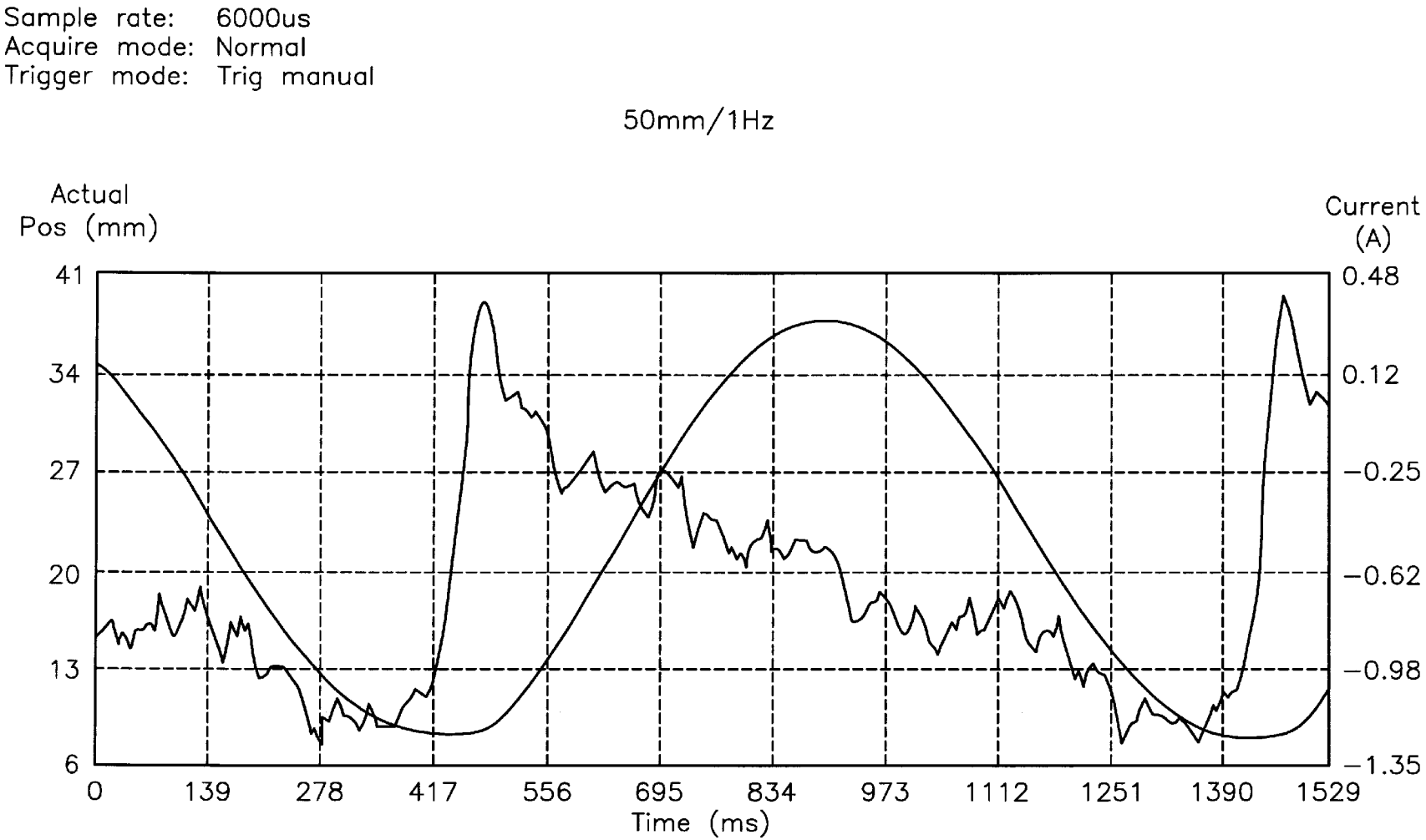
FIG. 12 is a graph showing actual position of agitator and input signal (in Amperes) versus time, for the test at frequency of 1 Hz.
Figure 13:
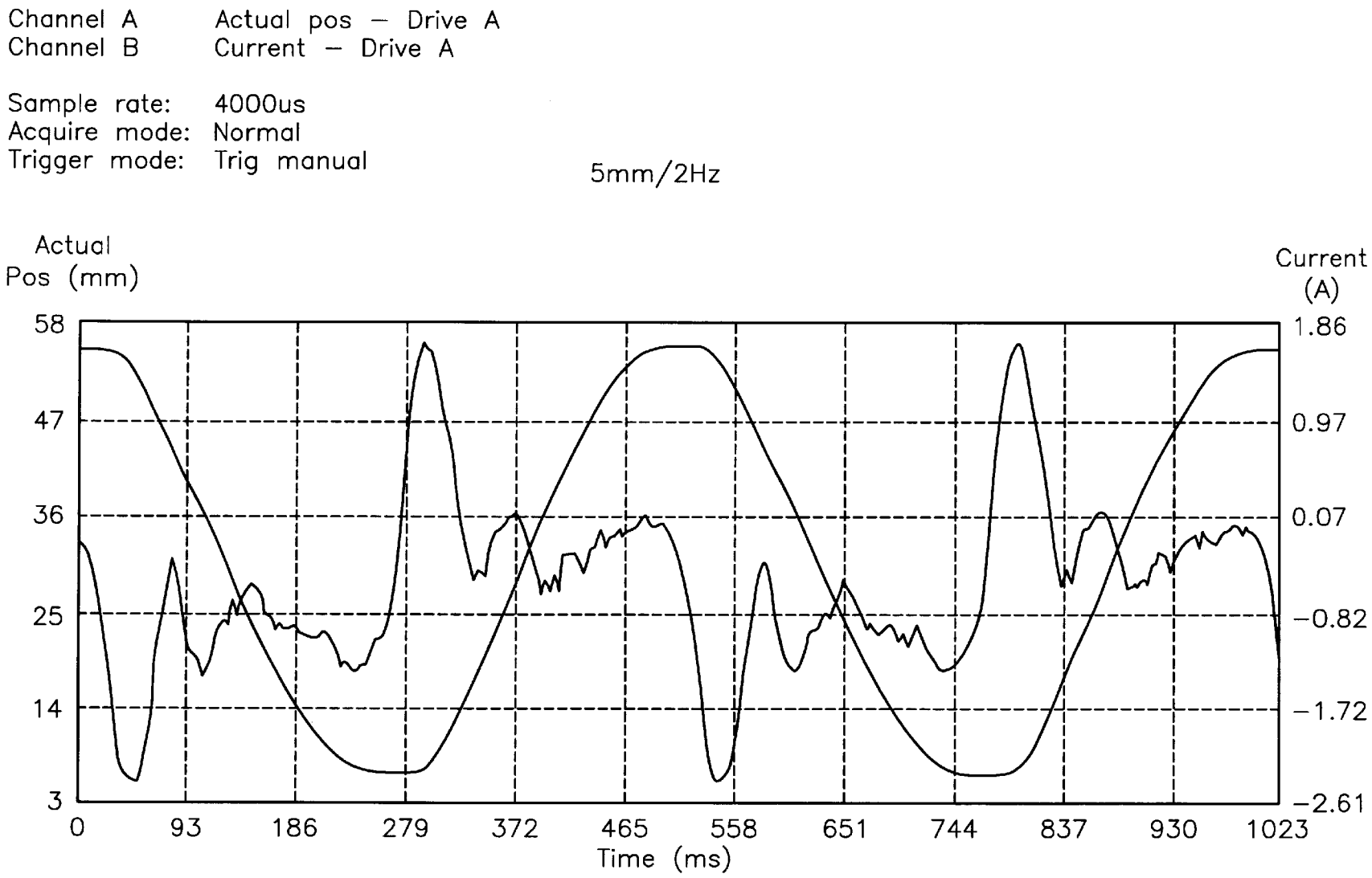
FIG. 13 is a graph similar to FIG. 12, for the test at frequency of 2 Hz.
Figure 14:
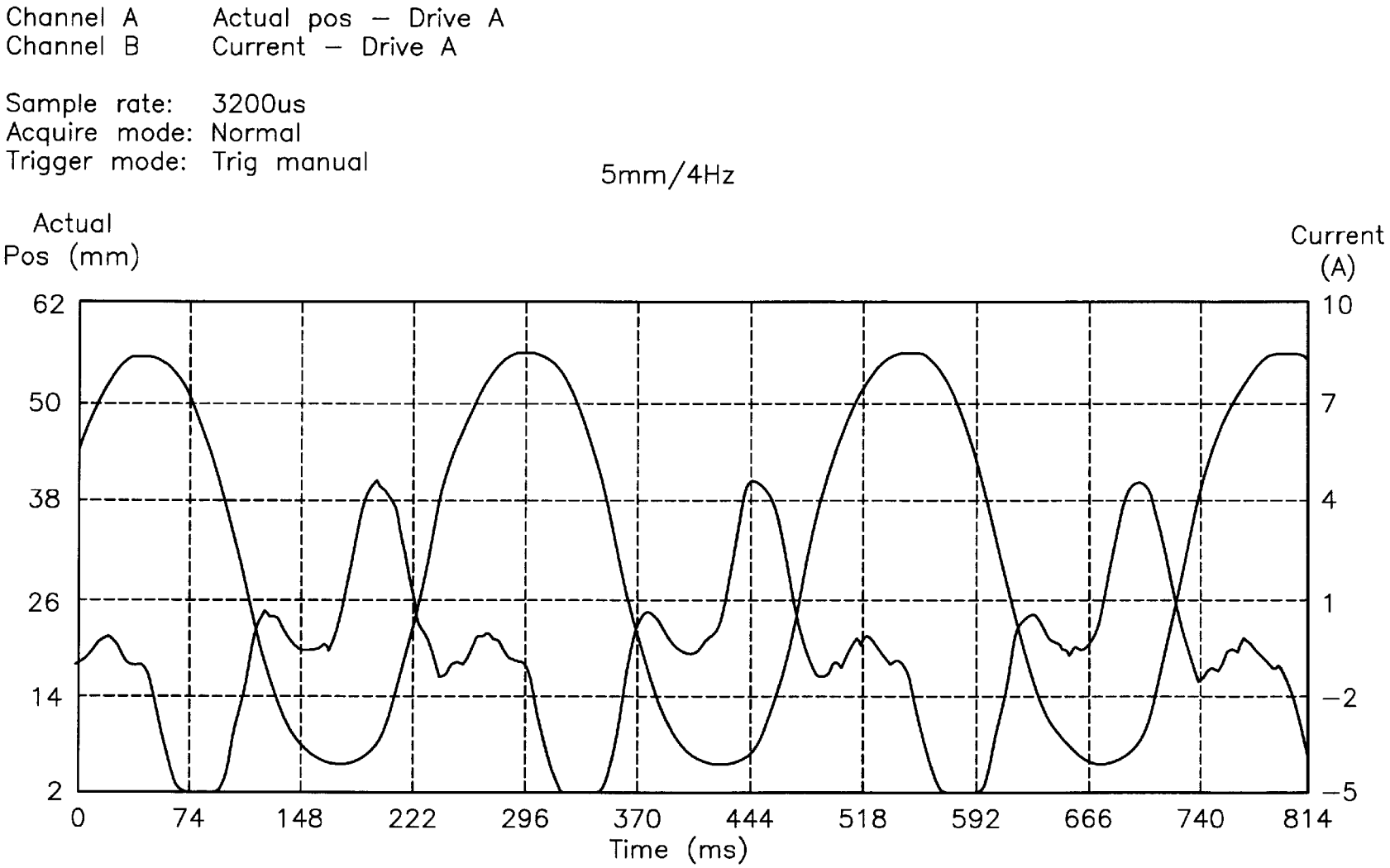
FIG. 14 is a graph similar to FIG. 12, for the test at frequency of 4 Hz.

FIGS. 12, 13, and 14 show how the instantaneous position of the agitator varies when driven for 50 mm travel by a sinusoidal signal at 1 Hz, 2 Hz, and 4 Hz respectively.

FIG. 15 is a table showing the power consumption in watts of a linear motor drive embodiment of the invention as shown in FIGS. 3 and 4. A 230-mm diameter stirrer plate was used in a 100-liter vessel filled 460 mm from the bottom. The motor (PO1-37×240/160×360) with a E1000-MT drive unit was operated continuously with a sinusoidal drive signal. Travel of the stirrer plate was varied in 10-mm steps from 10 mm to 50 mm. Power consumption was measured in the vessel filled with water and in the empty vessel, and the difference was calculated. Frequency was varied from 2 Hz to 9 Hz.

Those skilled in the art will recognize that the invention set forth herein may be embodied in various sizes and alternative forms. The foregoing disclosure of particular embodiments is exemplary and is not intended to limit the scope of the claims.

What is claimed is:

1. A vibration mixer comprising:

an electronic controller;

a motor attached to the electronic controller, said motor having a drive shaft assembly comprising a motor drive shaft and drive shaft housing;

a mixing vessel; and an agitating assembly extending into the mixing vessel, said agitating assembly having vibrational motion and having a connection to the motor drive shaft, wherein said connection is adapted so that the vibrational motion of the agitating assembly expresses as reciprocating motion;

wherein the electronic controller comprises an electronic control unit for generating control signals, whereby the control signals provide independent and simultaneous control over frequency and amplitude of vibrational motion of the agitating assembly; and a motor drive unit communicating with the electronic control unit and providing energy to power the motor in accordance with the control signals, wherein the control signals provide independent and simultaneous control over a continuous range of frequencies of the vibrational motion of the agitating assembly, wherein the frequency range has a minimum of about 0.01 Herz and a maximum of about 10 Hz, and wherein the control signals provide independent and simultaneous control over a continuous range of amplitudes of the vibrational motion of the agitating assembly, wherein the amplitude range has a minimum of about 1 micron and a maximum of greater than one meter.

2. The apparatus of claim 1, further comprising a plurality of agitator assemblies, a means for connecting each agitator assembly to the motor drive shaft and a plurality of mixing vessels, whereby in powering the motor drive shaft, the motor causes each agitator assembly to mix so that material in the plurality of vessels experiences a virtually identical agitating profile.

3. A vibration mixer comprising:

an electronic controller;

a motor attached to the electronic controller, said motor having a drive shaft assembly comprising a motor drive shaft and a drive shaft housing;

a mixing vessel; and an agitating assembly extending into the mixing vessel, said agitating assembly having vibrational motion and having a connection to the motor drive shaft, wherein said connection is adapted so that the vibrational motion of the agitating assembly expresses as reciprocating motion;

a sensor located in the mixing vessel, and a measuring device for determining degree of mixing of material in the vessel;

wherein said sensor is connected to and provides input to said measuring device, wherein the electronic controller comprises an electronic control unit for generating control signals in accordance with the determination of degree of mixing, whereby said control signals provide control over the independent and simultaneous control over frequency and amplitude of the vibrational motion of the agitating assembly; and a motor drive unit communicating with the electronic control unit and providing energy to power the motor in accordance with the control signals, wherein the control signals provide independent and simultaneous control over a continuous range of frequencies of the vibrational motion of the agitating assembly, wherein the frequency range has a minimum of about 0.01 Herz and a maximum of about 10 Hz, and wherein the control signals provide independent and simultaneous control over a continuous range of amplitudes of the vibrational motion of the agitating assembly, wherein the amplitude range has a minimum of about one micron and a maximum of greater than one meter.

4. The apparatus of claim 1 or 3, wherein the motor is selected from the group consisting of a stepper motor, a linear motor and a DC continuous motor.

5. The apparatus of claim 4, wherein the agitating assembly is mounted directly onto the motor drive shaft, whereby the motor causes reciprocating motion of the motor drive shaft, said motor drive shaft providing reciprocating motion to the agitating assembly.

6. The mixer of claim 4, wherein the agitating assembly is connected to the motor drive shaft through a means for converting rotational motion to reciprocating motion, whereby the motor causes rotating motion of the motor drive shaft, said rotating motion being converted to reciprocating motion through the converting means, said converting means providing reciprocating motion to the agitating assembly.

7. The mixer of claim 5, where said converting means comprises a ball-bearing spindle.

8. The apparatus of claim 1 or 3, wherein the motor is a linear motor, said linear motor providing reciprocating motion to the motor drive shaft, said motor drive shaft providing reciprocating motion to the agitating assembly.

9. The apparatus of claim 1 or 3, wherein the motor is a linear motor and wherein the mixing vessel has a range of holding capacities, said range having a minimum of about two liters and a maximum of about three hundred liters.

10. The apparatus of claim 1 or 3, wherein the motor is a stepper motor having a rotating motor assembly, said assembly having a rotating motor drive shaft, wherein said motor drive shaft is attached to a ball-bearing spindle, wherein said spindle provides reciprocating motion to the agitating assembly.

11. The apparatus of claim 1 or 3, further comprising a means for sealing material in the mixing vessel from surrounding air.

12. The apparatus of claim 11, wherein the maximum amplitude of vibrational motion of the agitating assembly is smaller than five millimeters and wherein the means for sealing comprises a sealing membrane made of flexible substance suitable to contain material in the vessel.

13. The apparatus of claim 11, wherein the maximum amplitude of the vibrational motion of the agitating assembly is greater than five millimeters and wherein the means for sealing comprises a bellows, said bellows being adapted to accommodate pressure inside the mixing vessel.

14. The apparatus of claim 1 or 3, wherein the agitating assembly comprises an agitator shaft and at least one stirrer plate, said plate attached to said agitator shaft.

15. The apparatus of claim 14, the agitating assembly being adapted so as to mix material in the mixing vessel with low shear forces.

16. The apparatus of claim 15, wherein the agitating assembly comprises at least one stirrer plate having a plurality of fructo-conical holes therethrough and wherein the amplitude of the agitating assembly in the vessel ranges continuously from a minimum to a maximum, said minimum being about 0.1 millimeter and said maximum about 60 millimeters and wherein the frequency of the vibrational motion of the agitating assembly ranges continuously from a minimum to a maximum, said minimum being about 0.1 Herz and said maximum being about 6 Herz.

17. The apparatus of claim 15, having a plurality of fructo-conical holes therethrough, wherein the at least one stirrer plate is perpendicularly attached to the shaft and wherein the fructo-conical holes have axes perpendicular to the direction of motion of the agitator shaft.

18. The apparatus of claim 17, wherein the fructo-conical holes can be arranged to taper from any edge of the stirrer plate to an opposing edge.

19. A method of using a vibration mixer comprising an agitating assembly and an electronic controller having, an electronic control unit for generating control signals, whereby the control signals provide independent and simultaneous control over the frequency and amplitude of vibrational motion of the agitating assembly, and a motor drive unit communicating with the electronic control unit, comprising the steps of:

a) programming the electronic controller with a range of frequencies and amplitudes of vibrational motion of the agitating assembly;

b) the electronic control unit generating control signals, wherein said control signals indicate a range of amplitudes and frequencies of the vibrational motion of the agitating assembly, c) the motor drive unit powering the motor in accordance with the control signals so that the variation of the amplitudes occurs simultaneously and independently of the variation of the frequencies;

d) the motor driving the agitating assembly in accordance with the control signals so that the variation of the amplitudes occurs simultaneously and independently of the variation of the frequencies.

20. A method of using a vibration mixer comprising an agitating assembly, a sensor, a measuring device, and an electronic controller having an electronic control unit for generating control signals, whereby the control signals provide independent and simultaneous control over the frequency and amplitude of vibrational motion of the agitating assembly, and a motor drive unit communicating with the electronic control unit, comprising the steps of:

a) programming the electronic controller with a range of frequencies and amplitudes of the vibrational motion of the agitating assembly;

b) setting up a desired degree of mixing, whereby the values of parameters indicative of degree of mixing are predefined;

c) programming the predefined degree of mixing into the electronic control unit;

d) the electronic control unit generating control signals;

e) the motor drive unit powering the motor in accordance with the control signals so that the variation of the amplitudes occurs simultaneously and independently of the variation of the frequencies;

f) the motor moving the agitating assembly in accordance with the control signals so that the variation of the amplitudes occurs simultaneously and independently of the variation of the frequencies;

g) the agitator assembly mixing in accordance with the control signals so that the variation of the amplitudes occurs simultaneously and independently of the variation of the frequencies;

h) the sensor detecting parameters indicative of degree of mixing of material in the vessel;

i) the sensor transmitting to the measuring device input signals, said signals conveying the parameters indicative of degree of mixing, j) using said parameters, the measuring device determining whether the predefined degree of mixing of material in the vessel has been achieved;

k) the measuring device transmitting signals to the electronic control unit;

l) the mixer carrying out as many iterations of steps d) to k) as necessary to achieve a state wherein the measuring device determines that the predefined degree of mixing has been achieved.

21. A method of using a vibration mixer comprising an electronic controller;

a motor attached to the electronic controller, said motor having a drive shaft assembly comprising a motor drive shaft and drive shaft housing;

a mixing vessel; and an agitating assembly extending into the mixing vessel, said agitating assembly having vibrational motion and having a connection to the motor drive shaft, wherein said connection is adapted so that the vibrational motion of the agitating assembly expresses as reciprocating motion; and wherein the electronic controller comprises an electronic control unit for generating control signals, whereby the control signals provide independent and simultaneous control over the frequency and amplitude of vibrational motion of the agitating assembly; and a motor drive unit communicating with the electronic control unit and providing energy to power the motor in accordance with the control signals, wherein the control signals provide independent and simultaneous control over a continuous range of frequencies of the vibrational motion of the agitating assembly, wherein the frequency range has a minimum of about 0.01 Herz and a maximum of about 10 Hz, and wherein the control signals provide independent and simultaneous control over a continuous range of amplitudes of the vibrational motion of the agitating assembly, wherein the amplitude range has a minimum of about 1 micron and a maximum of greater than one meter, said method comprising the steps of:

a) programming the electronic controller with a range of frequencies and a range of amplitudes of the vibrational motion of the agitating assembly;

b) the electronic control unit generating control signals, wherein said control signals indicate a range of amplitudes and frequencies of the vibrational motion of the agitating assembly, c) the motor drive unit powering the motor in accordance with the control signals so that the variation of the amplitudes occurs simultaneously and independently of the variation of the frequencies;

d) the motor driving the agitating assembly in accordance with the control signals so that the variation of the amplitudes occurs simultaneously and independently of the variation of the frequencies;

e) the agitating assembly mixing material in the vessel in accordance with the control signals so that the variation of the amplitudes occurs simultaneously and independently of the variation of the frequencies.

22. A method of using a vibration mixer comprising:

an electronic controller;

a motor attached to the electronic controller, said motor having a drive shaft assembly comprising a motor drive shaft and a drive shaft housing;

a mixing vessel, an agitating assembly extending into the mixing vessel, said agitating assembly having vibrational motion and having a connection to the motor drive shaft, wherein said connection is adapted so that the vibrational motion of the agitating assembly expresses as reciprocating motion; and a sensor located in the mixing vessel, a measuring device for determining degree of mixing of material in the vessel;

wherein said sensor is connected to and providing input to said measuring device, wherein the electronic controller comprises an electronic control unit for generating control signals in accordance with the determination of degree of mixing, whereby said control signals provide independent and simultaneous control over the frequency and amplitude of the vibrational motion of the agitating assembly; and a motor drive unit communicating with the electronic control unit and providing energy to power the motor in accordance with the control signals, wherein the control signals provide independent and simultaneous control over a continuous range of frequencies of the vibrational motion of the agitating assembly, wherein the frequency range has a minimum of about 0.01 Herz and a maximum of about 10 Hz, and wherein the control signals provide independent and simultaneous control over a continuous range of amplitudes of the vibrational motion of the agitating assembly, wherein the amplitude range has a minimum of about one micron and a maximum of greater than one meter, said method comprising the steps of:

a) programming the electronic controller with a range of frequencies and amplitudes of the vibrational motion of the agitating assembly;

b) setting up a desired degree of mixing, whereby the values of parameters indicative of degree of mixing are predefined;

c) programming the predefined degree of mixing into the electronic control unit;

d) the electronic control unit generating control signals;

e) the motor drive unit powering the motor in accordance with the control signals so that the variation of the amplitudes occurs simultaneously and independently of the variation of the frequencies;

f) the motor moving the agitating assembly in accordance with the control signals so that the variation of the amplitudes occurs simultaneously and independently of the variation of the frequencies;

g) the agitator assembly mixing materials in a container in accordance with the control signals so that the variation of the amplitudes occurs simultaneously and independently of the variation of the frequencies;

h) the sensor detecting parameters indicative of degree of mixing of material in the vessel;

i) the sensor transmitting to the measuring device input signals, said signals conveying the parameters indicative of degree of mixing, j) using said parameters, the measuring device determining whether the predefined degree of mixing of material in the vessel has been achieved;

k) the measuring device transmitting signals to the electronic control unit;

l) the mixer carrying out as many iterations of steps d) to k) as necessary to achieve a state wherein the measuring device determines that the predefined degree of mixing has been achieved.

23. The method of claim 21 or 22, wherein the vibration mixer further comprises a plurality of agitator assemblies, a means for connecting each agitator assembly to the motor drive shaft and a plurality of mixing vessels whereby in powering the motor drive shaft, the motor causes each agitator assembly to mix so that material in the plurality of vessels experiences a virtually identical agitating profile.

24. The method of claim 21 or 22, wherein the agitating assembly is adapted so as to mix material in the mixing vessel with low shear forces.

25. The method of claim 21 or 22, wherein the agitating assembly comprises at least one stirrer plate having a plurality of fructo-conical holes therethrough and wherein the amplitude of the agitating assembly in the vessel ranges continuously from a minimum to a maximum, said minimum being about 0.1 millimeter and said maximum about 60 millimeters and wherein the frequency of the vibrational motion of the agitating assembly ranges continuously from a minimum to a maximum, said minimum being about 0.1 Herz and said maximum being about 6 Herz.

26. The method of claim 21 or 22, wherein the maximum amplitude of vibrational motion of the agitating assembly is smaller than five millimeters and wherein the means for sealing comprises a sealing membrane made of flexible substance suitable to contain material in the vessel.

27. The method of claim 21 or 22, wherein the maximum amplitude of the vibrational motion of the agitating assembly is greater than five millimeters and wherein the means for sealing comprises a bellows, said bellows being adapted to accommodate pressure inside the mixing vessel.

28. The method of claim 21 or 22, further comprising the step of programming the electronic controller to provide optimal frequencies and amplitudes of the vibrational motion of the agitating assembly, whereby rising viscosity and polymer chain breakage are minimized while also providing the desired degree of mixing for effectuating chemical reactions.

29. The method of claim 21 or 22, wherein very large amplitude of vibrational motion of the agitating assembly is provided, whereby settled solids from deep within a mixture are carried to the surface to produce a homogeneous suspension.

30. The method of claim 21 or 22, wherein the agitating assembly vibrates with a reciprocating motion.

* * * * *